United States Patent [19]

Eder et al.

[11] Patent Number: 4,763,823

[45] Date of Patent: Aug. 16, 1988

[54] TAPE FEED APPARATUS

[75] Inventors: Erich Eder, Donaustrauf; Horst Winter, Neutraubling, both of Fed. Rep. of Germany

[73] Assignee: Krones AG Hermann Kronseder Maschinenfabrik, Neutraubling, Fed. Rep. of Germany

[21] Appl. No.: 52,015

[22] Filed: May 19, 1987

[30] Foreign Application Priority Data

May 24, 1986 [DE] Fed. Rep. of Germany ..... 3617583

[51] Int. Cl.[4] ..... B65C 9/18; B65H 20/02

[52] U.S. Cl. ..... 226/109; 156/521; 156/568; 156/DIG. 33; 226/181; 242/58

[58] Field of Search ..... 156/504, 519, 521, 568, 156/DIG. 33; 226/110; 242/58

[56] References Cited

U.S. PATENT DOCUMENTS

| | | | |
|---|---|---|---|
| 2,246,456 | 6/1941 | Quigley | 226/110 |
| 3,064,869 | 11/1962 | Cooper | 226/110 |
| 3,306,801 | 2/1967 | Giles | 156/504 |
| 3,850,356 | 11/1974 | Abe et al. | 226/110 |
| 3,957,570 | 5/1976 | Helm | 156/568 |
| 4,078,961 | 3/1978 | Aoki et al. | 156/504 |

*Primary Examiner*—Michael Wityshyn

*Attorney, Agent, or Firm*—Fuller, Puerner & Hohenfeldt

[57] ABSTRACT

Apparatus for supplying tape from a roll with two alternately driven tape feed rollers and a motor driven drive system which produces a rotational movement has overrunning clutches arranged between the motor drive system and the tape feed rollers, respectively, said clutches making a continuous change of materials removed from a supply roll to another roll possible with a reversal in the rotational direction of the drive motor, whereby in one direction of motor rotation only one overrunning clutch makes a connection with its feed roller and in the other direction of motor rotation only the other overrunning clutch provides a rotational connection to its feed roller.

5 Claims, 3 Drawing Sheets

TAPE FEED APPARATUS

BACKGROUND OF THE INVENTION

The invention disclosed herein pertains to apparatus for supplying tape to a utilization device such as a device for applying labels to bottles and the like.

The new apparatus is for assuring that as soon as the tape on one roll or coil is expended, there will be a simultaneous starting of tape feed from a standby roll so the supply of tape to the utilization device will never be interrupted. During the time that tape is being supplied from the standby roll, the machine attendant will have time to replace the depleted roll with a new roll of tape and the new roll then becomes the standby roll.

Continuous tape feed devices are generally known. In one type, a drive mechanism including a gear runs continuously in the same direction. The gear is connected with two roll shaped feed elements by means of other gears and two electromagnetically activated switch couplings. Proper timing as well as the energy supply for the switching couplings requires the use of a substantial amount of sophisticated and complex control equipment. Hence, the reliability and durability of this known device is poor.

In another known device for supplying tape from coils the two feed rollers are simultaneously driven continuously and a single counter roller is provided which is supported on a rocking lever, said counter roller alternately functioning with one of the two feed rollers. A disadvantage of this device is that the feed roller, which is not functioning together with the counter roller, slides on the beginning end of the coiled tape. This results in abrasion of the tape and a certain amount of undesired feeding action. In this device, the material located in the standby position must, therefore, be held in place by means of an additional brake which complicates the structure.

SUMMARY OF THE INVENTION

An objective of the invention is to provide apparatus for supplying a band or tape from alternate coils, which apparatus is simple and, hence, more reliable than prior art devices that are designed to perform the same functions.

Briefly stated, the new feed apparatus employs two feed rolls one of which is kept at rest while the other is activated and feeding. This is accomplished in a simple matter based on changing the direction of rotation of the drive device which is preferably based on a reversible electric motor. The coupling and decoupling of the feed elements constituting rollers is brought about entirely automatically by means of two overrunning clutches that are self-actuating. Driving with a dc motor is advantageous since its rotational direction can be reversed in a fraction of a second and the motor can be accelerated to the desired speed in a fraction of a second. In some applications, the capability of regulating the speed of the dc motor is advantageous. An important feature of the new tape feed apparatus is that it uses two feed rollers which are in tangential contact with counter rollers, respectively, and at least one of the two counter rollers can be driven, by means of an over running clutch and a drive mechanism, opposite to the normal feed direction. This makes it possible to pull back the end of the material by a certain amount so as to not influence the motion of the coiled material while a new roll is being installed, for example.

How the above-mentioned general objective and other more specific objectives of the invention are achieved will be evident in the ensuing more detailed description of a preferred embodiment of the invention which will now be set forth in reference to the drawings.

DESCRIPTION OF A PREFERRED EMBODIMENT

The word "tape" is used herein as a generic term for tape, band, strip, sheet or any other thin flexible material that may advantageously be withdrawn from rolls.

Figure 1:
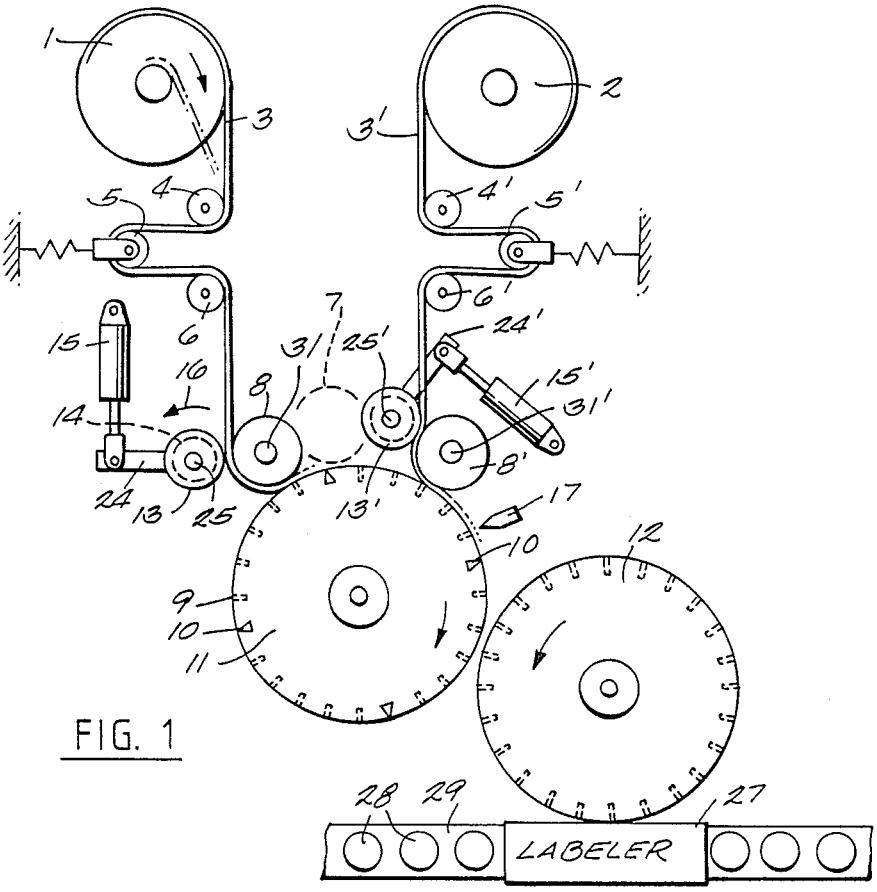
FIG. 1 is a top view, largely schematic, of the new apparatus for supplying coiled material such as tape or a band to a utilization device such as a bottle labeling machine.

Attention is invited to FIG. 1.

There are two rolls 1 and 2 of tape and they are mounted for turning about their axes. When roll 1 is full the tape feeds off the roll, as indicated by the leader 3 after which it loops around three rollers 4, 5 and 6 which are part of the tape tensioning device that is depicted more completely in FIG. 4. In FIG. 1, the tape 3 coming off of the roll 1 is shown as a solid line indicative of the roll being nearly full and the phantom line indicates the angle at which the tape is fed off the roll when the roll is nearly depleted. The right hand roll 2 is shown as being full of tape which is fed off as indicated by the numeral 3'. The tape runs over three rollers 4, 5, 6 of a tensioning device that includes a spring 26. The tensioning device will be discussed later. When one of the tape rolls 1 or 2 becomes depleted, there is an automatic inactivation of the elements that feed the tape from that roll and a simultaneous activation of the elements that feed the tape from the other full roll which has been on standby. The prime mover of the apparatus is a reversible electric motor 7. The motor 7 is depicted in dash-dot lines in FIGS. 1 and 3 and in solid lines in FIG. 2.

FIG. 1 illustrates that the tape feeds around tensioning rollers 4, 5 and 6 and then around a feed roller 8. After that the tape runs on a vacuum roller 11 which has a plurality of suction holes 9 in its periphery for attracting the tape to the roller. There are several knives 10 distributed equiangularly about the periphery of vacuum roller 11. A fixed counter knife 17 cooperates with the rotating knives 10 so that the tape material can be cut to exact length constituting labels, in this example. The labels are then transferred to another rotating transfer vacuum roller 12 which turns oppositely to roller 11 and is supplied with vacuum holes in a similar manner. The apparatus can be used to feed tape to various tape utilization devices where interruption of the feed to replenish tape rolls cannot be tolerated. A machine for applying labels to bottles is symbolized by the rectangle marked 27. Bottles such as those marked 28 are conveyed through the label applying machine 27 on a conveyor 29.

Elements in the left tape feed system in FIG. 1 are given certain reference numerals and corresponding elements in the similar right tape feed system are given similar references affiliated with a prime mark. During a production run, one of the systems will be in a standby condition and will contain a fresh roll of tape while the other system will be actively dispensing tape until its roll is depleted.

Figure 2:
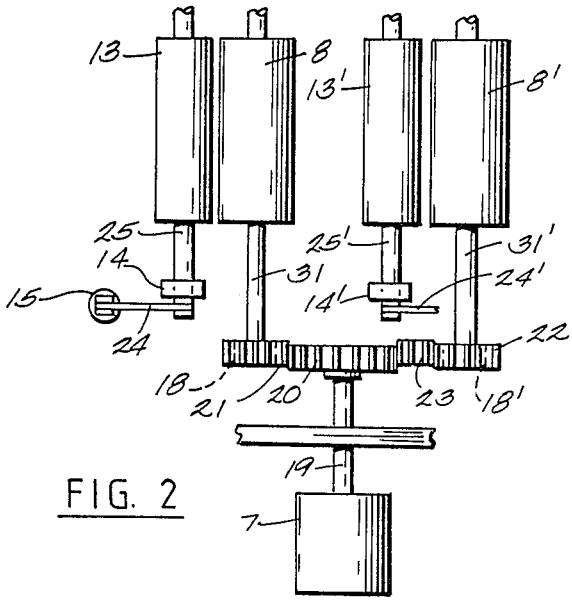
FIG. 2 is a side elevational view of the tape feed elements and drive elements of the apparatus depicted in FIG. 1.
Figure 3A:
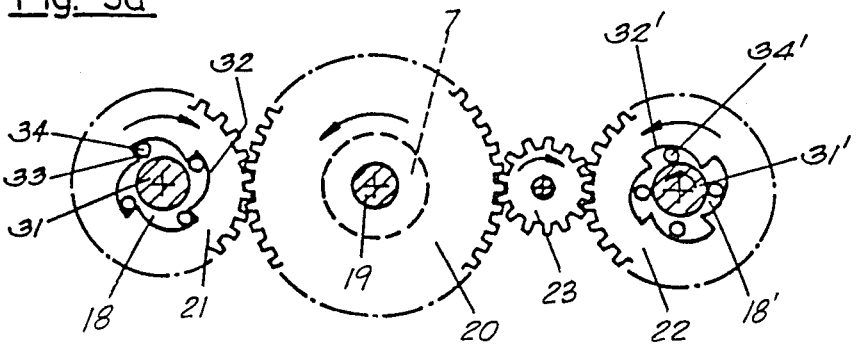
FIGS. 3*a* and 3*b* are top views of the tape feed elements wherein the feed roll drive gears in 3*b* are rotating oppositely of the feed roll drive gears in 3*a*.
Figure 3B:
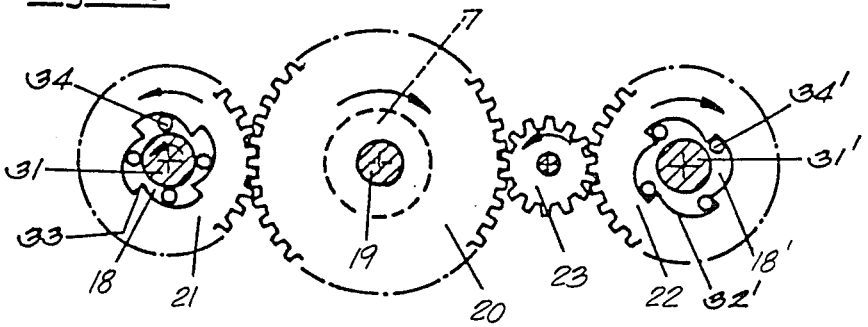

In FIG. 1, one may see that the tape runs over about one quadrant of the periphery of a feed element in the form of a feed roller 8. It will be evident later when FIGS. 2, 3*a* and 3*b* are discussed that feed roller 8 is driven through an overrunning clutch 18. There is another roller 13, called a counter roller, in tangential contact with feed roller 8. Counter rollers 13 and 13' are free wheeling. Counter roller 13 is fixed on a shaft 25 and rotates with the shaft when clutch 18 is locked to turn the shaft. The bearings journalling the shaft for rotation are not shown. A work cylinder 15 which is preferably a pneumatic cylinder is anchored at one end. Its piston is pivotally connected to a lever 24 which can be driven in the direction which is in a direction opposite of the normal feed direction indicated by the arrow 16. Lever 24 is fixedly connected to the shaft 25 on which counter roller 13 is fixed. As will be explained in more detail later, when the work cylinder 15 drives in the direction opposite of the arrow 16 in FIG. 4, overrunning clutch 14 locks counter roller 13 to shaft 25, so the counter roller 13 is driven rotationally for part of a revolution opposite to its normal feed direction to let tape end 3 retract. When work cylinder 15 reverses in a moment clutch 14 releases and counter roller 13 is free to turn on shaft 25 again.

The mechanism for withdrawing tape from the standby or replacement roll 2 is constructed similar to the mechanism that withdraws tape 3 from tape supply roll 1. When a new full tape roll 2 is installed, the end portion of the tape remains in the area around the feed roller 8' which corresponds to the feed roller 8. A counter roller 13' is tangent to feed roll 8'. The piston rod of a work cylinder 15' is connected to a lever 24'. The work cylinder drives counter roller 13' which is equipped with an overrunning clutch 14'. Means are provided for reversing feed rollers 8 and 8' simultaneously when withdrawing of tape is switched between the alternatively active and standby tape rolls 1 and 2. Rollers 8 and 8' are driven by way of another pair of overrunning clutches 18 and 18'. The drive system for the rollers includes a reversible electric motor 7 which, when it runs in one direction of rotation, will rotate only feed roller 8 and when it rotates in the opposite direction will rotate only feed roller 8'. The gear train including gears 21–23 and overrunning clutches 18 and 18' shown in FIGS. 2 and 3 transmits the power from electric motor 7 to the feed rollers 8 and 8' alternately. In FIG. 2, the drive system includes the electric motor 7 and its output shaft 19. There is a gear 20 fastened to shaft 19. As is evident in FIGS. 2 and 3, there are two power take-off gears 21 and 22 which participate in driving and in activating shafts 25 and 25' alternately. As can be seen most clearly in FIGS. 3*a* and 3*b*, the driven shaft for the feed roller 8 is marked 31 and the drive shaft for feed roller 8' is marked 31'. Gear 20 on motor shaft 19 will rotate in the direction of the arrow on the gear as shown in FIG. 3*a* for one direction of rotation in which the left feed roll 8 is rotating. FIG. 3*b* shows how gear 20 reverses with the motor 7 to cause the right feed roll 8' to rotate and withdraw tape. There is an intermediate gear 23 which serves the purpose of making the outside gears 21 and 22 always rotate in opposite directions from each other whether the drive gear 20 is rotating clockwise or counterclockwise. Power takeoff gears 21 and 22 are coupled to feed roll shafts 31 and 31', by means of the overrunning clutches 18 and 18' respectively. The clutches 18 and 18' are symbolic. To obtain the clutching action, gear 21 has four involute slots 32. Each slot terminates in a shoulder 33. There are some cylinder drop rods 34 in the recess. In some clutches balls are used in place of rods. The arrow indicates clockwise motion by gear 21 FIG. 3*a*. As a result, the drop rods ride along the involute surfaces 32 and come to a stop against shoulders 33 at which time the rods form no interconnection between the clutch gear 21 and shaft 31 of feed roller 8. The situation is different in the right clutch 22 in FIG. 3*a*. Gear 22 is rotating counterclockwise as indicated by the arrow. As a result, the rods 34 are caused to wedge between the involute surfaces 32 and shaft 31'. Thus, in FIG. 3*a*, the right shaft 31' is being driven counterclockwise but the left shaft 31 is not being driven because overrunning clutch will be free but gear 21 will be rotating due to its connection with main drive gear 20. Thus, only feed roller 8' will be running a drawing tape from roll 2. In FIG. 3*b*, the drive motor 7 has been reversed as compared with FIG. 3*a* in which case the main drive gear 20 is also rotationally reversed. In the left clutch 21 of FIG. 3*b* the rods 34 are wedging and driving the left shaft 31 counterclockwise so the left feed roller 8 is driven counterclockwise. The right drop rods 34' in FIG. 3*b* are not making a wedging connection between the gear 22 and shaft 31 so feed roll 8' which is fixed on shaft 31' would not be turning.

FIG. 1 shows that the start of the tape material 3' of the replacement roll 2 is held in a region near the periphery of roller 11 until the supply roll 1 is consumed to the point where low tape quantity is sensed by a sensor which is not shown. After cut off and transfer of the last piece of tape, which may be the label for a bottle, from supply roll 1, tape delivery from supply roll 1 is terminated. In order to prevent a remnant of the tape from roll 1 remaining in the in flow area of the tape 3' during the simultaneous or nearly simultaneous automatic operation of the delivery mechanism for the replacement roll 2 by means of feed roll 8' the remnant is marginally retracted from the roller pair 8, 13 far enough that the slipping in of the tape segment 3' is excluded.

Figure 4:
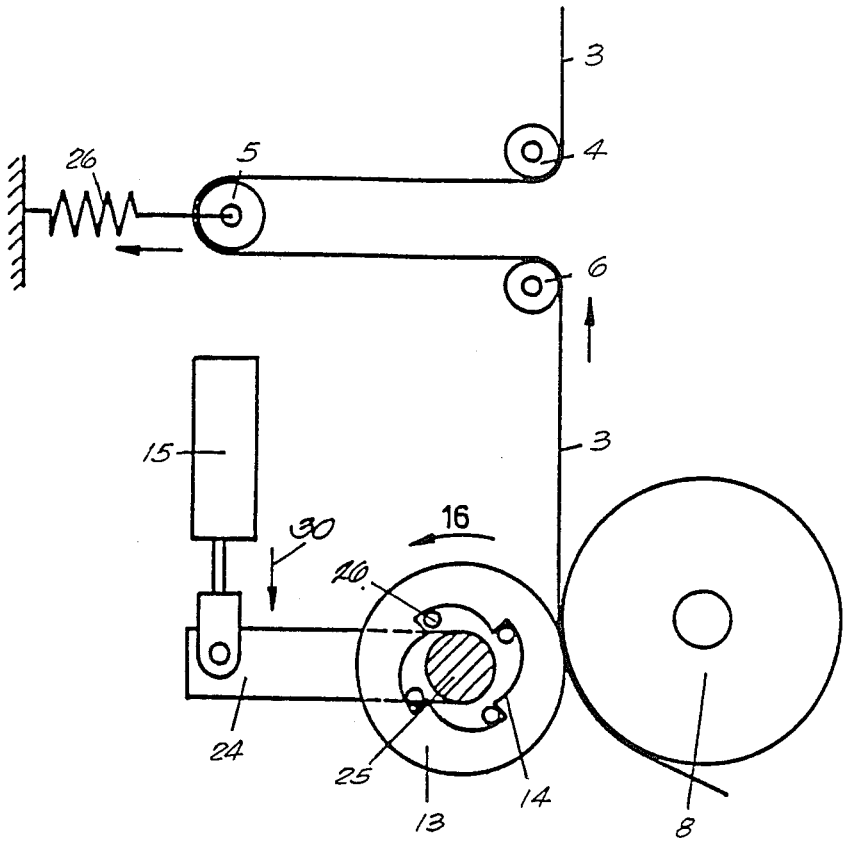
FIG. 4 is a plan view of the drive system including an overrunning clutch involved in driving one of the counter rollers.

Reverse rotation of each of the mating rollers 8 and 13 results from work cylinder 15 rotating lever 24. As is shown in FIG. 4, the lever 24 is fixed to the shaft 25 on which the counter roller 13 is rotatably supported. Shaft 25 is also rotatable but is at rest under normal operating conditions when the driven feed roller 8 is at rest. Consequently, overrunning clutch 14 which is employed between shaft 25 and counter roller 13 permits unhindered rotation of counter roller 13 in the feed direction. On the other hand, rotation of the counter roller 13 over the free roller 18 and against the feed direction, is blocked. The spring 26 that acts on the compensating roller 5 to maintain proper tension in the tape as it is being withdrawn, cannot pull back the tape 3. If, however, the shaft 25 pivots through a given angle in the direction of the arrow 16 which is opposite of the feed direction, then the tape material 3 is pulled back by means of the spring loaded compensating roller 5 for an appropriate distance.

I claim:

1. Apparatus for withdrawing tape or the like alternately from at least two rotatably mounted tape rolls and feeding said tape to a utilization device, said apparatus comprising:

a first rotatably mounted feed roller over which the tape withdrawn from one of the tape rolls runs and a second rotatably mounted feed roller over which the tape withdrawn alternately from the other of the tape rolls runs, a reversible drive system, first and second overrunning clutch means interposed between said drive system and said first and second feed rollers, respectively, one of said clutch means responding to said drive system running in one direction by coupling said drive system in driving relation with one of said feed rollers and the other of said clutch means responding to said drive system running in the opposite direction by coupling said drive system in driving relation with the other of said feed rollers.

2. The apparatus according to claim 1 including a reversible electric motor driving said drive system.

3. The apparatus according to claim 1 including.

a reversible electric motor driving said drive system, said motor having a power output shaft, first and second shafts on which said feed rollers, respectively, are fixed to provide for said rotatable mounting of said feed rollers, a drive gear fixed on said power output shaft of the motor, a first driven gear meashed with said drive gear, said driven gear being rotatable on the shaft of said first feed roller and one of said overrunning clutch means being interposed between said first driven gear and the shaft of said first feed roller, a second driven gear being rotatable on the shaft of said second feed roller and another of said overrunning clutch means being interposed between said second driven gear and the shaft of said second feed roller, an intermediate gear meshed with said drive gear and said second driven gear for driving said second driven gear rotationally opposite of said first driven gear.

4. Apparatus according to any one of claims 1, 2 or 3 including:

first and second counter roller shafts mounted for rotation and a counter roller on each of said counter roller shafts, respectively, for rotating parallel to and in tangential contact with said feed rollers, respectively, said tapes being gripped between said counter rollers and said feed rollers for withdrawing tape from a tape roll when contacting feed rollers and counter rollers, respectively, are rotating in one direction, a free running clutch interposed between each of said counter roller shafts and the counter roller thereon, said free running clutches being arranged to allow said counter rollers to turn freely when said counter rollers and feed rollers are cooperating to withdraw tape, means for selectively activating one free running clutch at a time momentarily for the counter roller in tangetial contact with the feed roller which is at rest to cause said last named counter roller to lock with the selected counter roller shaft on which said last named counter roller is mounted, and for simultaneously rotating said selected counter roller shaft and counter roller in a direction that causes said tape to be retracted by a small amount in a direction opposite of the direction of withdrawal.

5. The apparatus according to claim 4 wherein:

said means for actuating one of said free running clutches at a time are respective work cylinders having piston rods, respectively, lever means for connecting said piston rods, respectively, to the shaft of the selected free running clutch on which shaft said counter roller tangential to said feed roller at rest turns, operation of said work cylinder causing said shaft of said selected free running clutch to rotate and rotation of said last named shaft actuating said one free running clutch to lock said counter roller tangential to said feed roller at rest to said shaft and block rotation of the last named counter roller opposite ot the tape withdrawal direction.

* * * * *